United States Patent [19]

Pasternak et al.

[11] 4,111,665

[45] Sep. 5, 1978

[54] APPARATUS FOR THE GASIFICATION UNDER PRESSURE OF BITUMINOUS COAL, ESPECIALLY OF FINE COAL IN A GENERATOR

[75] Inventors: Rudolf Pasternak, Gladbeck; Jochen Bauer, Essen, both of Fed. Rep. of Germany

[73] Assignee: Steag A.G., Essen, Fed. Rep. of Germany

[21] Appl. No.: 720,985

[22] Filed: Sep. 7, 1976

[30] Foreign Application Priority Data

Sep. 9, 1975 [DE] Fed. Rep. of Germany ..... 2540166

[51] Int. Cl.[2] ..... C10J 3/50

[52] U.S. Cl. ..... 48/77; 44/10 C; 48/86 R; 201/6; 202/118; 214/17 B

[58] Field of Search ..... 48/86 R, 77, 76, 101, 48/210; 44/10 C, 13; 201/6, 22, 24; 202/118; 214/17 B, 17 C; 222/194, 410

[56] References Cited

U.S. PATENT DOCUMENTS

| | | | |
|---|---|---|---|
| 749,302 | 1/1904 | Koneman | 48/86 R |
| 2,675,304 | 4/1954 | Komarek | 44/13 |
| 3,756,434 | 9/1973 | Teske | 214/17 B |

FOREIGN PATENT DOCUMENTS

| | | | |
|---|---|---|---|
| 988,301 | 4/1976 | Canada | 44/10 C |
| 555,164 | 6/1932 | Fed. Rep. of Germany | 201/6 |
| 262,901 | 12/1926 | United Kingdom | 214/17 B |

*Primary Examiner*—Robert L. Lindsay, Jr.
*Assistant Examiner*—George C. Yeung
*Attorney, Agent, or Firm*—Malcolm W. Fraser

[57] ABSTRACT

Apparatus for the gasification under pressure of bituminous coal, especially fine coal, comprising a generator which has a container to receive the coal to be gasified and a feed device which supplies the coal to the container, while keeping the container closed off so as to maintain the pressure in the generator. The feed device includes a briquette forming device located on the container, and a continuously operable screw conveyor which feeds the coal to be gasified through the briquette forming device and directly into the container in the form of briquettes. The feed device is encapsulated and, together with the fine coal and briquettes within it, forms a gas tight closure for the container to maintain the pressure therein.

2 Claims, 1 Drawing Figure

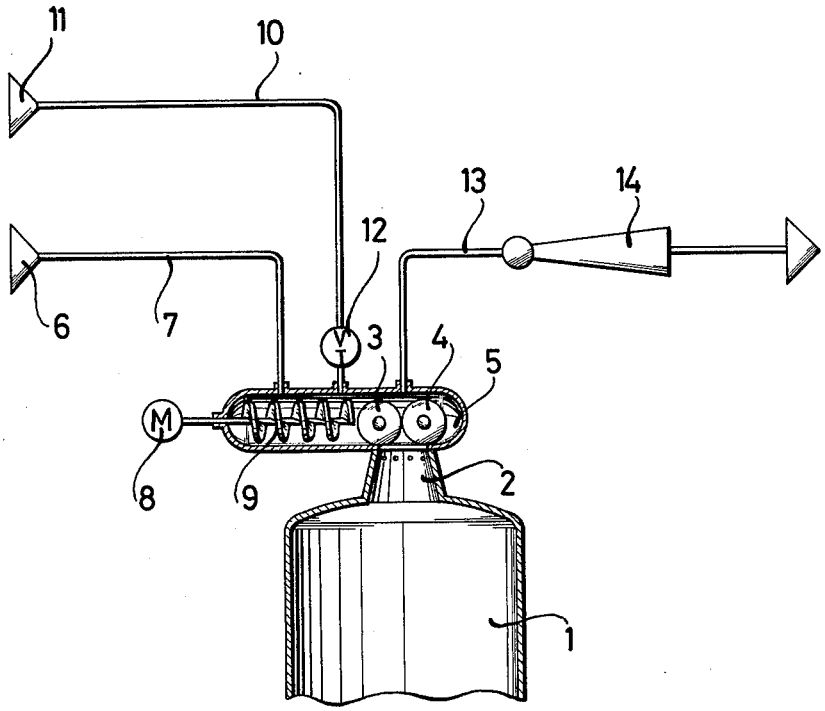
11
10
13
14
12
6
7
V
3
4
5
M
8
9
2
1

APPARATUS FOR THE GASIFICATION UNDER PRESSURE OF BITUMINOUS COAL, ESPECIALLY OF FINE COAL IN A GENERATOR

BACKGROUND OF THE INVENTION

The invention relates to an apparatus for the gasification of bituminous coal, especially fine coal, comprising a generator which has a container to receive the coal to be gasified, and a feed device which supplies the coal to the container, while keeping the generator closed off so as to maintain the pressure in the generator.

The gasification of bituminous coal under pressure is known per se. Generally it is carried out in so-called generators of which various types of construction are known. In principle, however, all generators feature a container in which the exothermic reactions of the coal to be gasified take place. The slag and ash are drawn off at the lower end of the container while coal is fed to the container at its upper end. Various forms of feed device including gas tight closing-off of the generator are known, as well as a distributor arranged below the feed device to ensure an even loading of the container.

Designs of these so-called fixed bed generators are especially known in which the coal is fed to the container by way of a sluice. The sluice has upper and lower gas tight closures which can be operated either hydraulically or pneumatically.

When the upper closure is open the sluice is not pressurized and coal to be gasified is fed into the sluice from a supply hopper situated above it. After filling, the upper closure is closed and sluice is put under pressure from pressurized gas. Only after the sluice has been put under pressure is the lower closure opened so that the coal to be gasified finds its way into the container. The lower closure is then reclosed and the empty sluice is depressurized. The gas released is collected in a gas container which is, in turn, sealed off. The gas so collected can be mixed with the gas generated.

In general finely divided coal is gasified, being a mixture of material prepared from general mine coal with a granular size of from 0–30 mm. Fine coal, however, cannot be fed directly into the container of the generator with this range of granular sizes because grain sizes of 0–2 mm interfere with the draught in the body and lead to a high dust incidence in the gas produced. For this reason the fine coal is graded so that material of a granular size of 2–30 mm is fed to the container. In practice, however, according to the quality of the grading and the amount of granular breakdown involved in it, a more or less large proportion of undersize material is present in the fed material.

This method of operating has the disadvantage that it excludes in practice the predominant amount of general mine coal from pressure gasification because investigations have shown that about 70% of general mine coal after preparation comes in granular size of under 2 mm. Furthermore, the grading of such large amounts of coal occasions a considerable expense which can considerably prejudice the economics of pressure gasification.

It is of course known that fine coal can be aggregated by a briquette forming process. The technique of making briquettes is normally, however, very expensive. It demands a graded grain size whose coarsest proportion may not exceed 8–10 mm. The fine coal fed to the fixed bed generators hitherto lies far outside this granular range.

Besides this, the usual process for making briquettes is followed by a cooling of the briquettes, which cooling is necessary to produce the required mechanical firmness. Such a treatment has always been required regardless of whether the forming of the briquettes has been carried out with the addition of a binder, e.g. coal tar, or without a binder, i.e. by the so-called 'hot briquetting' process.

The non-continuous feeding operation described above is also disadvantageous in the case of the known fixed bed generators, since considerable sluice gas losses occur.

The object of the invention is to obviate the non-continuous feeding of the coal by the feed device and also to render the undersize coal of 0–2 mm, so far rejected, suitable for gasification in a fixed bed generator.

SUMMARY OF THE INVENTION

According to the invention there is provided apparatus for the gasification under pressure of bituminous coal, especially fine coal, comprising a generator which has a container to receive the coal to be gasified and a feed device which supplies the coal to the container, while keeping the container closed off so as to maintain the pressure in the generator, wherein the feed device includes a briquette forming device located on the container, and a continuously operatable means to feed the coal to be gasified to the briquette forming device and directly into the container, the briquette forming device, in use, providing a closure for the container for the maintenance of the pressure therein.

In one form of apparatus according to the invention, fine coal of 0–30 mm grain size, or, following preparation, of 2–30 m grain size, (in any case low grain size coal from faulty extractions and coal exhibiting delayed friability) is charged into the briquette forming device. The briquette forming device produces a briquette that differs from the usual bituminous coal briquette by reason of its poorer quality. However, surprisingly a firmness of the briquette is achieved which is sufficient to avoid premature disintegration leading to blockages in the container of the generator. In particular these briquettes are gas permeable.

Loading of the briquettes takes place directly into the container. Thus the usual cooling when making briquettes is obviated. Furthermore, the load of fine coal passing to the briquette forming device, together with the briquettes leaving the device, and the briquette forming device itself block the escape of gas from the container resulting in substantially gas tight closure of the generator, (if the unavoidable but in practice easily handled small leakages are not taken into account). In this manner there is provided not only continuous loading of the coal in the form of briquettes, but also processing heat can easily be led from the generator and utilised, with the application of binders, in the making of briquettes by the hot process.

The invention has the advantage that the range of grain sizes which can be used no longer has a bearing on the process for gasification under pressure. The charging of the container with briquettes is essentially simpler than charging it with fine coal. It takes place continuously and sluice gas losses are therefore avoided. The use of briquettes also leads to a reduction in the quantity of dust borne out by the gas produced.

The briquette forming device can utilize the usual briquette presses, piston presses and especially roller presses, also ring-roller presses. In this event the rollers are located over the container of the generator and the roller clearances are arranged in such a way that the briquettes are fed directly into the container.

Preferably and according to a further characteristic of the invention the briquettes include pieces having a diameter of 8–15 mm, which are eminently suited for preventing the escape of gas from the container.

BRIEF DESCRIPTION OF THE DRAWING

The single FIGURE shows schematically the arrangement of a briquette forming roller press above a fixed bed generator of which the upper part only is shown.

DESCRIPTION OF THE PREFERRED EMBODIMENT

The generator includes a container 1 under pressure, the cover of which container is indicated at 2. Above the container are two briquetting rollers 3, 4 of a briquette forming device, rotating in opposition. The feed supply of the fine coal to be gasified comes from a bunker 6 through a line 7 which leads into the casing 5 of a screw conveyor 9, the drive for which is indicated schematically at 8. In the screw conveyor 9, the fine coal is mixed with a binder such as tar, or coal pitch, or other known binders for the making of briquettes. The binder comes from a storage container 11 by way of a line 10 and a metering device 12. The screw conveyor 9 feeds the mixture of binder and fine coal to the roller press comprising the two rollers 3 and 4.

A line 13 serves for the removal of leakage gas by a suction device and has an ejector 14 to which fuel is led.

As can be seen from the drawing the entire briquette forming device is encapsulated so as to be pressure tight and forms a closure for the container 1. The enclosure so formed is then substantially pressure tight since the encapsulated device, during operation, is filled with feed coal and briquettes which block the escape of gas through the device.

What we claim is:

1. An apparatus for the gasification of fine bituminous coal under pressure comprising a. a container provided with an inlet opening for receiving briquetted coal to be gasified, b. a closed casing fixed directly on said inlet opening, c. feeding means for feeding the fine feed coal into said closed casing, d. a briquette forming device within said closed casing immediately adjacent said inlet opening for forming briquettes from the fine feed coal and discharging the briquettes directly into said container, e. a pressure conveyor device within said closed casing for forcing the fine feed coal continuously to said briquette forming device, and f. a suction device leading from a portion of said casing remote from said inlet opening for removing any gas which may leak past the feeding means and the briquette forming device into said casing.

2. The apparatus according to claim 1, further comprising means for feeding a binder to said casing in metered quantities.

* * * * *